US011963560B2

(12) United States Patent
Lo

(10) Patent No.: US 11,963,560 B2
(45) Date of Patent: Apr. 23, 2024

(54) MEDICAL PROTECTIVE GARMENT

(71) Applicant: FUNG LEAD MEDICAL AND SPORTS CO., LTD., Nantou County (TW)

(72) Inventor: Szu-Chi Lo, Nantou County (TW)

(73) Assignee: FUNG LEAD MEDICAL AND SPORTS CO., LTD., Nantou County (TW)

( * ) Notice: Subject to any disclaimer, the term of this patent is extended or adjusted under 35 U.S.C. 154(b) by 71 days.

(21) Appl. No.: 17/145,377

(22) Filed: Jan. 10, 2021

(65) Prior Publication Data

US 2022/0218054 A1 Jul. 14, 2022

(51) Int. Cl.
*A41D 13/12* (2006.01)
*A41D 27/24* (2006.01)

(52) U.S. Cl.
CPC ..... *A41D 13/1218* (2013.01); *A41D 13/129* (2013.01); *A41D 27/245* (2013.01); *A41D 2200/20* (2013.01); *A41D 2300/322* (2013.01); *A41D 2600/20* (2013.01)

(58) Field of Classification Search
CPC .. A41D 13/1218; A41D 13/129; A41D 13/02; A41D 27/245; A41D 2200/20; A41D 2300/322; A41D 2600/20; A41D 7/00; A44B 19/10; A44B 19/16; A44B 19/34; B63C 9/087; Y10T 24/2514
USPC ..... 2/456, 457, 275
See application file for complete search history.

(56) References Cited

U.S. PATENT DOCUMENTS 3,100,897 A 8/1963 Sol
4,272,851 A * 6/1981 Goldstein ..... A62B 17/001 2/82
4,683,593 A 8/1987 Langley
5,487,189 A 1/1996 Bell
5,960,475 A 10/1999 Fewtrell
6,286,144 B1 9/2001 Henderson et al.
8,435,617 B2 * 5/2013 Hannon ..... B29C 65/5021 428/36.1

(Continued)

FOREIGN PATENT DOCUMENTS

CN 201550646 U 8/2010
CN 111329165 A 6/2020

(Continued)

*Primary Examiner* — Nathan E Durham
*Assistant Examiner* — Abby M Spatz
(74) *Attorney, Agent, or Firm* — Li & Cai Intellectual Property Office

(57) ABSTRACT

A medical protective garment including a pair of front fabric pieces, a pair of rear fabric pieces, a headgear fabric piece and a weldable zipper is provided. Each of the front fabric pieces includes an integral front body part, an integral front trouser and an integral front sleeve that are connected to each other. Each of the pair of rear fabric pieces includes an integral rear body part, an integral rear trouser and an integral rear sleeve that are connected to each other. Heat welding lines are formed on joints of the headgear fabric piece, the front fabric pieces and the rear fabric pieces. The weldable zipper includes a pair of zipper strips, and a material of the pair of zipper strips can be heat welded to any one of the pair of front fabric pieces, the pair of rear fabric pieces or the headgear fabric piece.

7 Claims, 10 Drawing Sheets

(56) References Cited

U.S. PATENT DOCUMENTS

| | | | | |
|---|---|---|---|---|
| 2009/0300891 | A1* | 12/2009 | Nanba | B65D 33/2508 24/399 |
| 2010/0175230 | A1* | 7/2010 | Kelsey | A44B 19/32 24/584.1 |
| 2015/0164153 | A1 | 6/2015 | Tsai | |
| 2020/0196717 | A1* | 6/2020 | Myerscough | A44B 19/32 |
| 2021/0037898 | A1* | 2/2021 | Bednar | A41D 13/129 |

FOREIGN PATENT DOCUMENTS

| | | | |
|---|---|---|---|
| EP | 0890319 | A2 | 1/1999 |
| JP | 2002235223 | A | 8/2002 |
| TW | M485624 | U | 9/2014 |
| TW | M593168 | U | 4/2020 |
| TW | M609425 | U | 3/2021 |
| WO | WO2017177285 | A1 | 10/2017 |

* cited by examiner

MEDICAL PROTECTIVE GARMENT

FIELD OF THE DISCLOSURE

The present disclosure relates to a medical protective garment, and more particularly to a medical protective garment capable of blocking external liquid from entering into the medical protective garment.

BACKGROUND OF THE DISCLOSURE

The joints between the headgear, the sleeves and the main body of the conventional medical protective garment are all achieved by stitching (overlock stitching). The passing of the sewing thread through the clothing material forms small pinholes, which easily affects the protective effect of the conventional medical protective garment. In order to solve this problem, the front side of the sewing thread, that is, the outer side of the clothing material, needs to be attached with a protective strip that has the protective effect. This type of strip can block out external liquid, which prevents the external liquid from entering into the interior of the protective garment from the gap between the stitches. However, attachment of the waterproof strip is not only manually performed and time consuming, but also increases the cost and the uncertainty of quality of the waterproof strips.

Furthermore, the conventional medical protective garment has stitching around the headgear and at the seams between the fabrics. Some stitching positions cannot be equipped with waterproof strips, which may lead to infiltration of external liquids, causing the effectiveness of the protective garment to be reduced.

In addition, gaps will also exist in the stitching between the front of the main body and the zipper of the conventional medical protective garment, and the material of the zipper fails to prevent the infiltration of external liquids into the protective garment.

Accordingly, how the protective effect of the medical protective garment can be improved through structural design to overcome the above-mentioned shortcomings has become an important issue in this technical field.

SUMMARY OF THE DISCLOSURE

In response to the above-referenced technical inadequacies, the present disclosure provides a medical protective garment with no stitches at the joints, which can reduce the number of small pinholes and increase protection performance. In addition, the number of waterproof strips can also be reduced, so as to reduce the time and cost associated with manual labor.

In one aspect, the present disclosure provides a medical protective garment including a pair of front fabric pieces, a pair of rear fabric pieces, a headgear fabric piece and a weldable zipper. Each of the pair of front fabric pieces includes an integral front body part, an integral front trouser and an integral front sleeve that are connected to each other. Each of the rear fabric pieces includes an integral rear body part, a rear trouser and a rear sleeve that are connected to each other. Heat welding lines are formed on joints of the headgear fabric piece, the pair of front fabric pieces and the rear fabric pieces. The weldable zipper includes a pair of zipper strips, a material of the pair of zipper strips being heat welded to any one of the pair of front fabric pieces, the pair of rear fabric pieces and the headgear fabric piece.

Therefore, one of the beneficial effects of the present disclosure is that the protective performance of the medical protective garment in the present disclosure is improved by heat welding all connections and cooperating with the structural features of the weldable zipper, while also reducing the number of waterproof strips, which in turn reduces the time and cost associated with manual labor.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
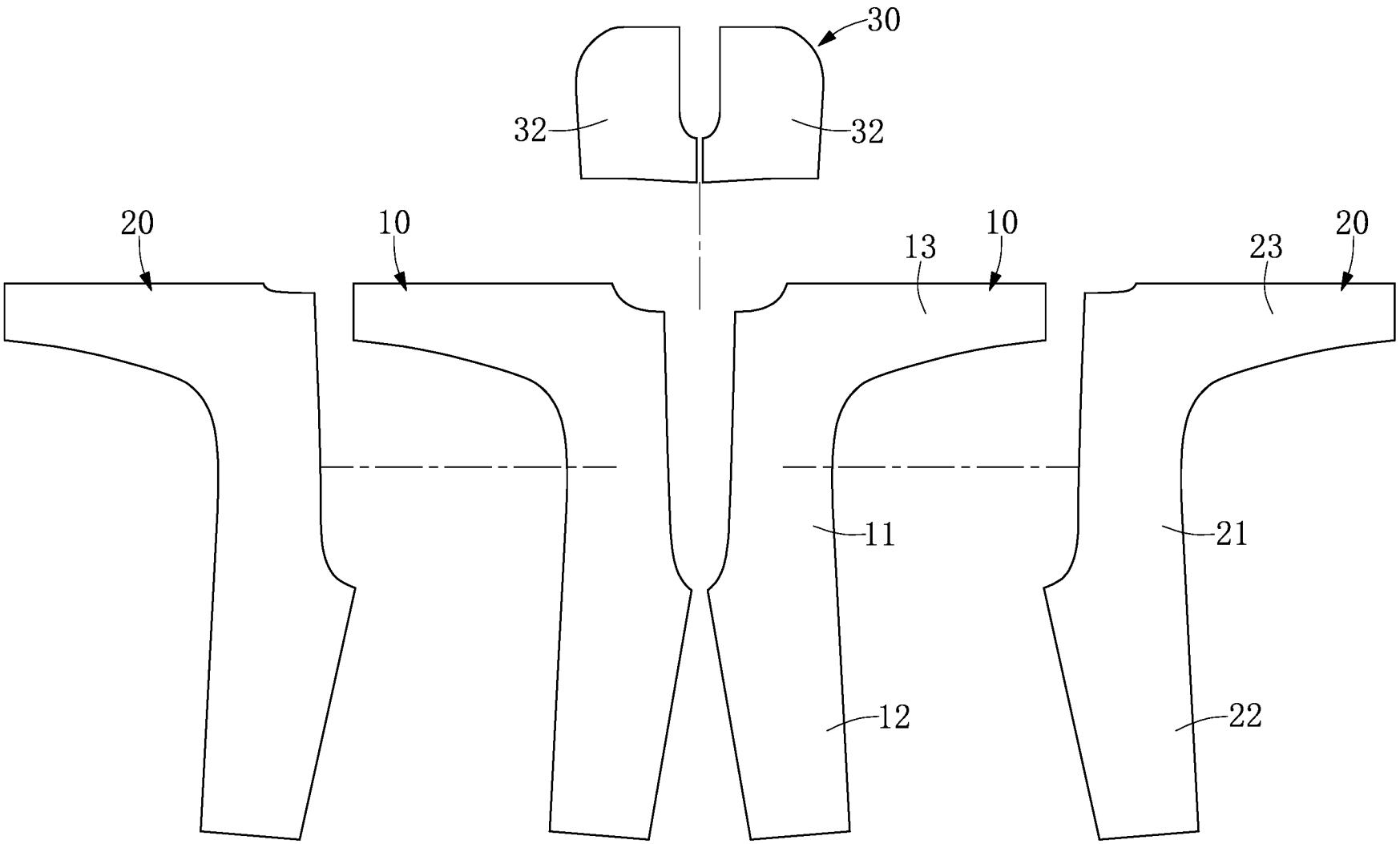
FIG. 1 is a schematic view illustrating a cutting of a fabric piece of a medical protective garment according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
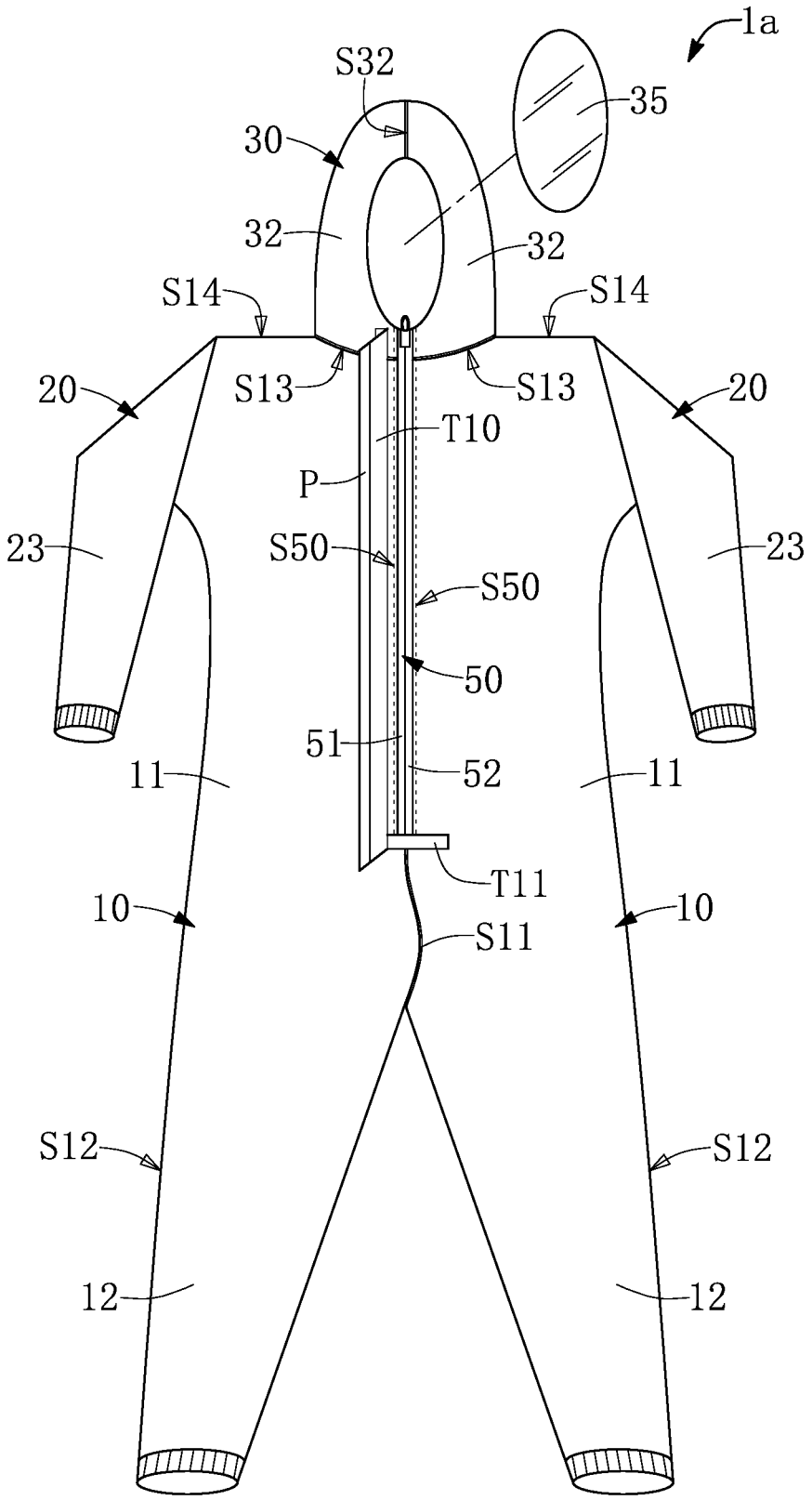
FIG. 2 is a front view of a medical protective garment according to a first embodiment of the present disclosure.
Figure 3:
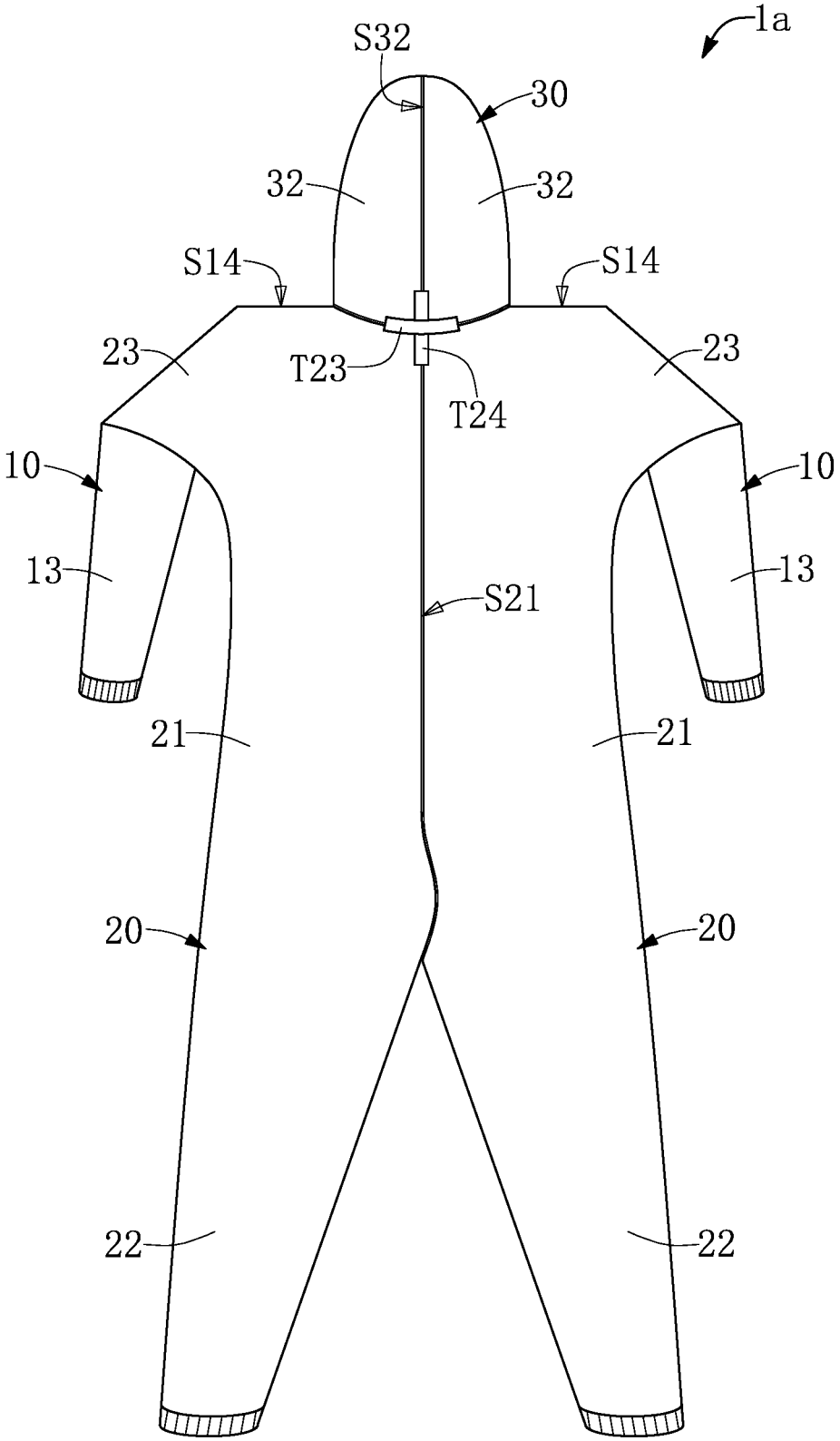
FIG. 3 is a rear view of the medical protective garment according to the first embodiment of the present disclosure.

Referring to FIG. 1 to FIG. 3, a first embodiment of the present disclosure provides a medical protective garment 1*a*, including a pair of front fabric pieces 10, a pair of rear fabric pieces 20, a headgear fabric piece 30 and a weldable zipper 50. One of the key technical features of the present disclosure is that there is no stitching between fabric pieces and at a seam between the fabric piece and the zipper, and they are all connected by heat welding. In other words, heat welding lines are formed on the joints of the headgear fabric piece 30, the pair of front fabric pieces 10 and the pair of rear fabric pieces 20 to avoid small pinholes caused by stitches, so as to increase the protective function of the medical protective garment 1*a*. In addition, due to reduction of the number of small pinholes, the number of waterproof strips can also be reduced, which can reduce production costs.

Referring to FIG. 1, a schematic view of a fabric piece cutting of a medical protective garment of the present disclosure is shown. One of the features of the present disclosure is the way that the fabric piece is cut, which allows the number of seams to be reduced. Each of the pair of front fabric pieces 10 includes an integral front body part 11, an integral front trouser 12 and an integral front sleeve 13, which are connected to each other. Each of the rear fabric pieces 20 includes an integral rear body part 21, an integral rear trouser 22 and an integral rear sleeve 23, which are connected to each other. The headgear fabric piece 30 is divided into two half headgear fabric pieces 32 as shown in FIG. 1. However, the present disclosure is not limited thereto. In the following embodiment, the headgear fabric piece 30 can also be a one-piece.

FIG. 2 and FIG. 3 respectively represent a front view and a back view of the medical protective garment according to the first embodiment of the present disclosure. The medical protective garment 1*a* in the present embodiment includes a weldable zipper 50 arranged on the front thereof, the weldable zipper 50 is arranged between the pair of front fabric pieces 10, and a pair of zipper strips 51 and 52 of the weldable zipper 50 respectively are connected to an inner edge of the pair of front fabric pieces 10. A front horizontal waterproof strip T11 is attached to a lower end of the weldable zipper 50. However, the present embodiment is not limited thereto; for example, either side of the weldable zipper 50 can also be attached with the waterproof strip.

Specifically, the back of the medical protective garment 1*a* has a rear central heat welding line S21 (FIG. 3) and a neck heat welding line S13 (FIG. 2). The rear central heat welding line S21 is connected to an inner edge of the pair of rear fabric pieces 20, which extends to the headgear fabric piece 30. The neck heat welding line S13 is connected to the headgear fabric piece 30 through the pair of rear fabric pieces 20. Waterproof strips T23 and T24 that are arranged in a cross shape are attached to the junction of the rear central heat welding line S21 and the neck heat welding line S13.

Figure 4:
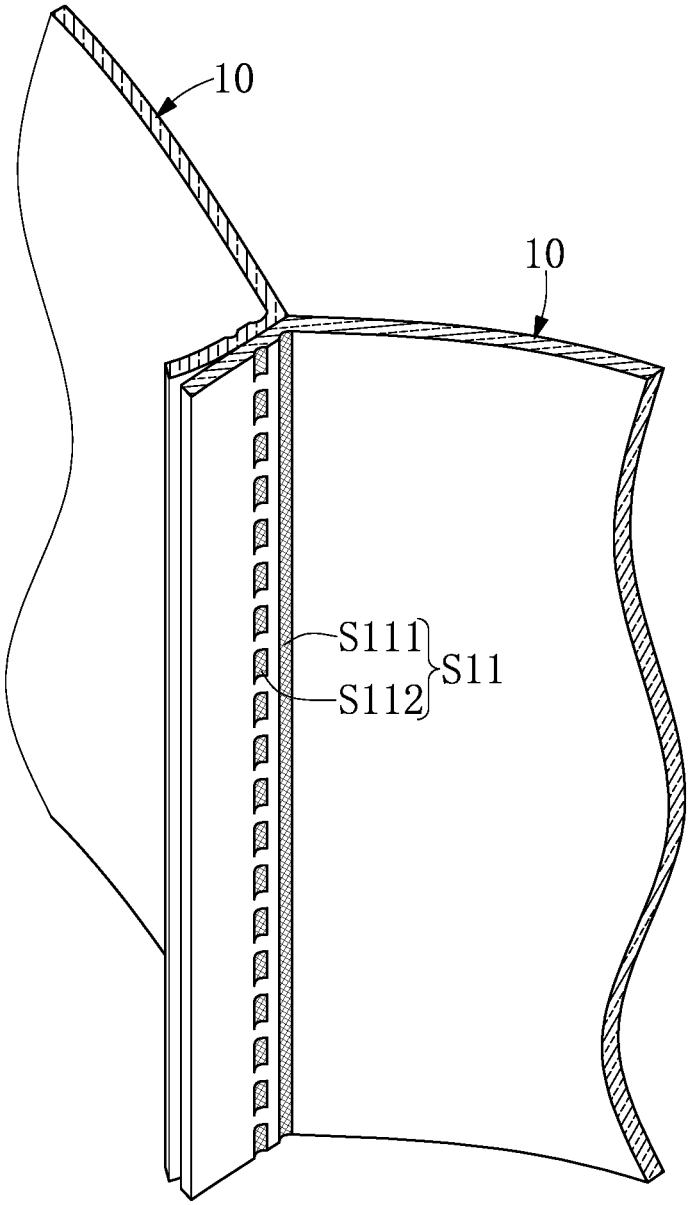
FIG. 4 is schematic view of a heat welding of the medical protective garment of the present disclosure.

FIG. 4 represents a schematic view of a heat welding between fabric pieces of the present embodiment. A heat welding solid line S111 and a heat welding broken line S112 are included in a front central heat welding line S11 to exemplarily exhibit manners in which each heat welding line can be formed. The heat welding broken line S112 is parallel to the heat welding solid line S111. Each heat welding line can further include one heat welding solid line S111 or one heat broken line S112 so that each heat welding line can be formed in a solid line-broken line-solid line arrangement or a solid line-broken line-broken line arrangement.

One of the features of the present disclosure is that it includes a weldable zipper 50 which includes a pair of zipper strips 51 and 52. The pair of zipper strips 51 and 52 can be heat welded to any one of the pair of front fabric pieces 10, the pair of rear fabric pieces 20 or the headgear fabric piece 30. The weldable zipper 50 can be, for example, a waterproof zipper, and both sides of the waterproof zipper are laminated with plastic films, such as PVC (polyvinyl chloride) or TPU (thermoplastic polyurethane). However, the present disclosure is not limited thereto. The material of the zipper strips 51 and 52 can be, for example, PET plastic (polyethylene terephthalate), polypropylene (PP, polypropylene) or the like.

In addition, in order to strengthen the protective effect, a front waterproof strip T10 can be attached to the weldable zipper 50 on the front of the medical protective garment 1*a* in the present embodiment. One side of the front waterproof strip T10 is first attached to any one side of the weldable zipper 50, and a release paper P is left on the other side of the front waterproof strip T10. After medical staff put on the medical protective garment 1*a*, they can tear off the release paper P, cover the weldable zipper 50 with the front waterproof strip T10, and attach the one side of the weldable zipper 50 to the other side of the weldable zipper 50. Therefore, the front of the weldable zipper 50 can be completely covered to achieve a good protective effect. In addition, as shown in FIG. 2, the medical protective garment of the present embodiment can further include a face shield 35. The face shield 35 is made of a transparent material, and can also be connected to the headgear fabric piece 30 by heat welding, thereby improving the protective effect.

Second Embodiment

Figure 5:
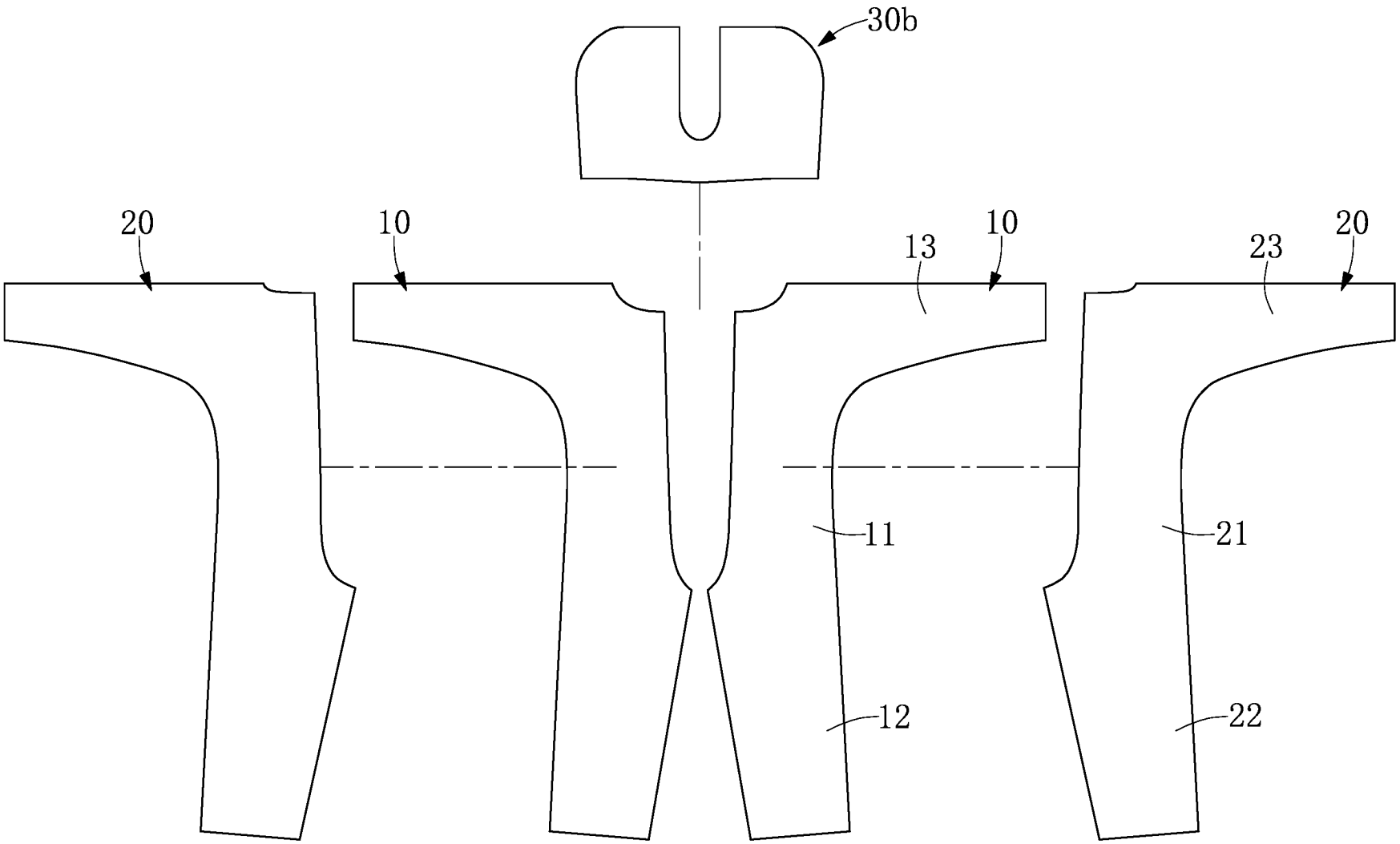
FIG. 5 is a schematic view illustrating another way of cutting a fabric piece of a medical protective garment according to the present disclosure.

FIG. 5 is a schematic view of a fabric piece cutting by another mode of the medical protective garment of the present disclosure. The difference from the above-mentioned embodiment is that the number of the fabric pieces is less, and the headgear fabric piece 30*b* is a one-piece structure.

Figure 7:
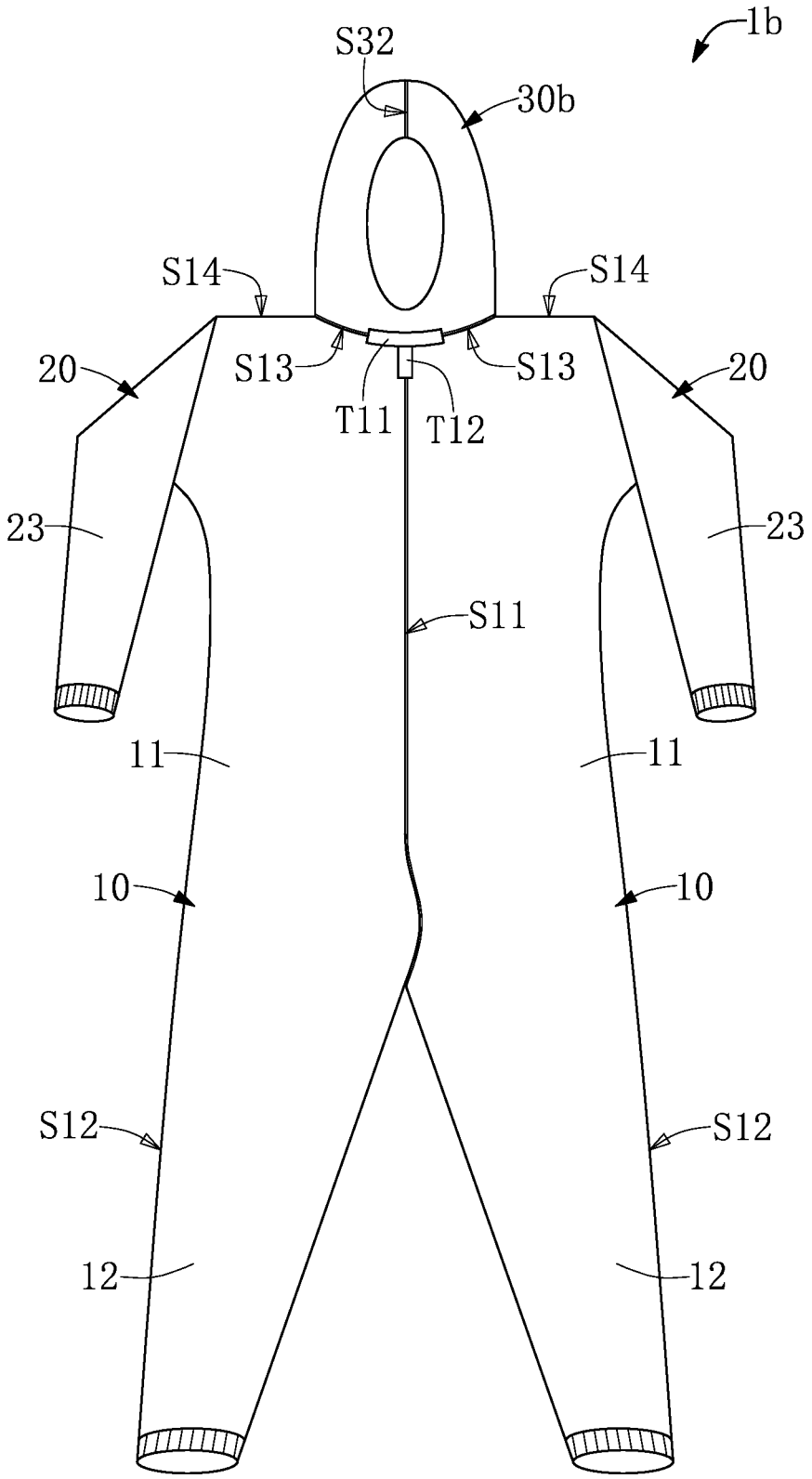
FIG. 7 is a front view of a medical protective garment according to a second embodiment of the present disclosure.
Figure 8:
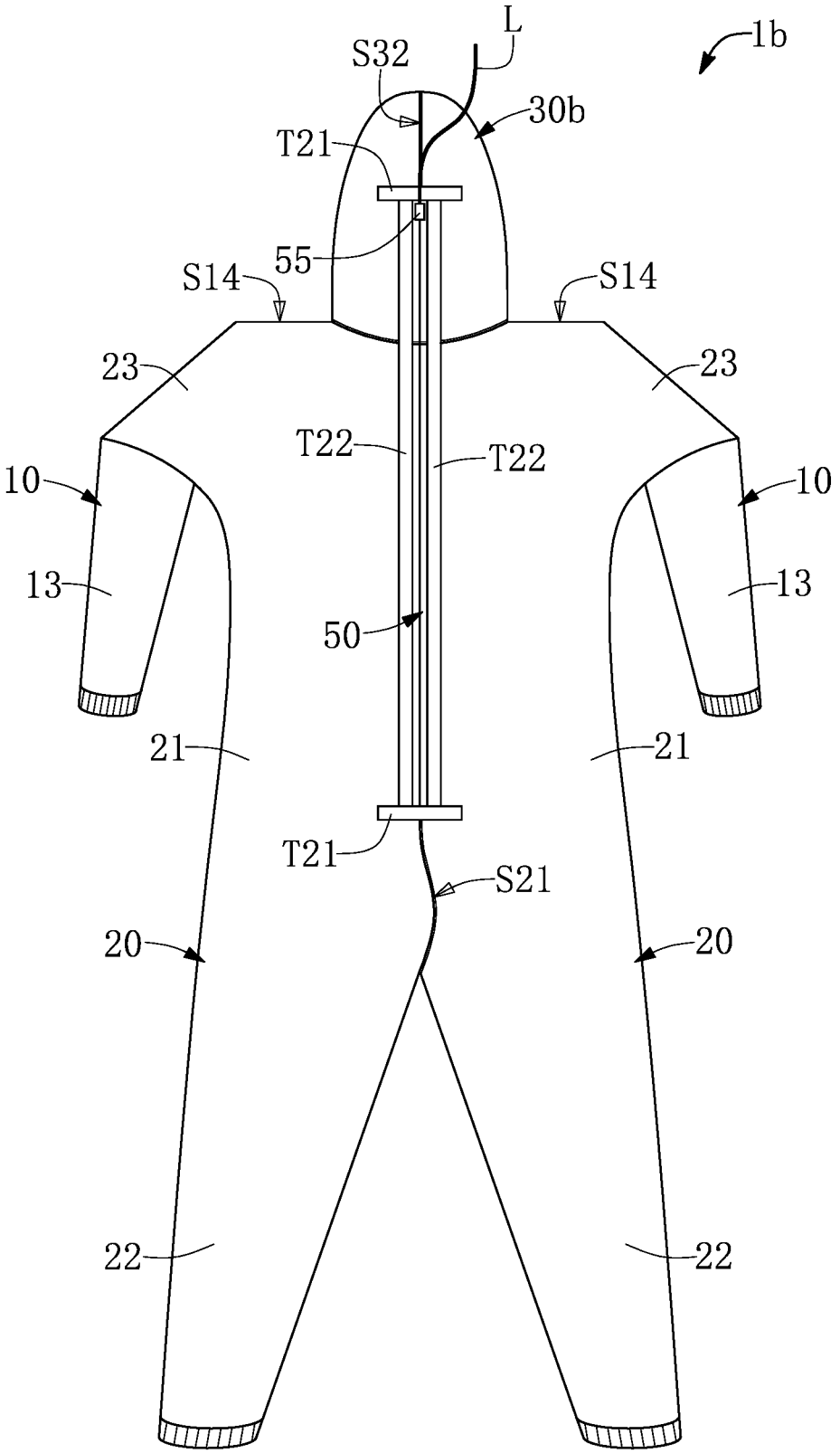
FIG. 8 is a rear view of the medical protective garment according to the second embodiment of the present disclosure.

In addition, an improved feature of the present embodiment is that the weldable zipper 50 is arranged on the back of the medical protective garment 1*a*, so as to be matched with the one-piece headgear fabric piece 30*b*. Referring to FIG. 5, FIG. 7 and FIG. 8, the weldable zipper 50 is disposed between the pair of rear fabric pieces 20, and the pair of zipper strips 51 and 52 of the weldable zipper 50 are respectively connected to an inner edge of the pair of rear fabric pieces 20. Thereby, small pinholes on the front of the medical protective garment 1*a* of the present embodiment that may be caused by the seams are effectively reduced. In particular, the medical protective garment 1*a* of the present embodiment does not include a zipper on the front, which reduces the possibility of generating some small pinholes around the zipper and can strengthen the protective function.

Specifically, the front of the medical protective garment 1*b* includes a front central heat welding line S11 and a neck heat welding line S13. The front central heat welding line S11 is connected to an inner edge of the pair of front fabric pieces 10, and the neck heat welding line S13 is connected to the headgear fabric piece 30 through the pair of front fabric pieces 10 and the pair of rear fabric pieces 20. A headgear heat welding line S32 is formed on the headgear fabric piece 30. Peripheral heat welding lines S12 and S14 are formed between the front fabric pieces 10 and the rear fabric pieces 20, including both sides of the sleeves, both sides of the body part and both sides of the trousers. The openings of the sleeves and trousers can be folded and elasticated, which can be achieved by stitching, since protective gloves or the like are often worn by the wearer.

In the present embodiment, the pair of zipper strips 51 and 52 of the weldable zipper 50 are further connected to the headgear fabric piece 30 through the neck heat welding line S13. This arrangement provides more space for the wearer, which can increase the wearing convenience.

In order to strengthen the protective function, the front of the medical protective garment 1*b* of the present embodiment may further include a front horizontal waterproof strip T11 and a front vertical waterproof strip T12, which respectively are attached to the junction of the front central heat welding line S11 and the neck heat welding line S13 to form a shape of the letter "T".

In addition, the back of the medical protective garment 1*b* may further include a pair of rear horizontal waterproof strips T21 and a pair of rear vertical waterproof strips T22. The pair of rear horizontal waterproof strips T21 are attached to an upper end and a lower end of the weldable zipper 50, respectively. The pair of rear vertical waterproof strips T22 are attached to both sides of the weldable zipper 50, respectively.

In order to make the medical protective garment 1*b* of the present embodiment more convenient to wear, a zipper pull 55 of the weldable zipper 50 can also be connected to a drawstring L. The drawstring L allows the wearer to pull the zipper pull 55 upward to close the weldable zipper 50.

Figure 6:
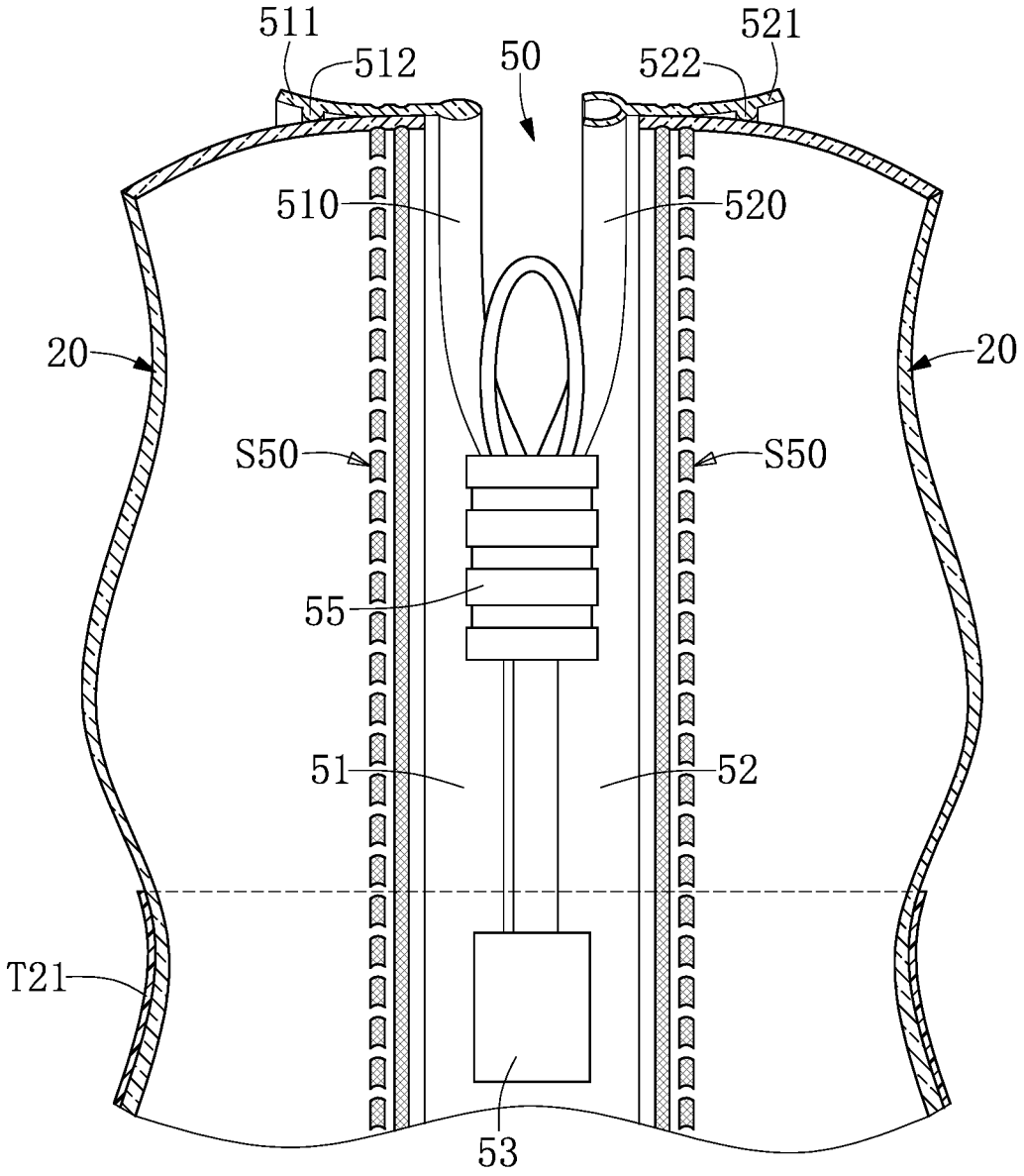
FIG. 6 is a schematic view of a joint of a weldable zipper being combined with a fabric of the medical protective garment of the present disclosure.

As shown in FIG. 6, the weldable zipper 50 in the present embodiment can be a ziplock zipper. The pair of zipper strips 51 and 52 of the weldable zipper 50 includes a sheet 511 and 521, respectively, wherein a convex rib 510 is formed on the sheet 511 and a clamping strip 520 is formed on the sheet 521, and the clamping strip 520 clamps the convex rib 510. In the present embodiment, in order to enable the weldable zipper 50 to be more conveniently and straightly connected to the fabric piece, the sheets 511 and 521 of the zipper strips 51 and 52 further includes a guiding protrusion 512 and 522, respectively. The guiding protrusions 512 and 522 can guide the rollers of the hot melt machine, so that the zipper strips 51 and 52 can be connected straightly to the fabric pieces of the medical protective garment.

Third Embodiment

Figure 9:
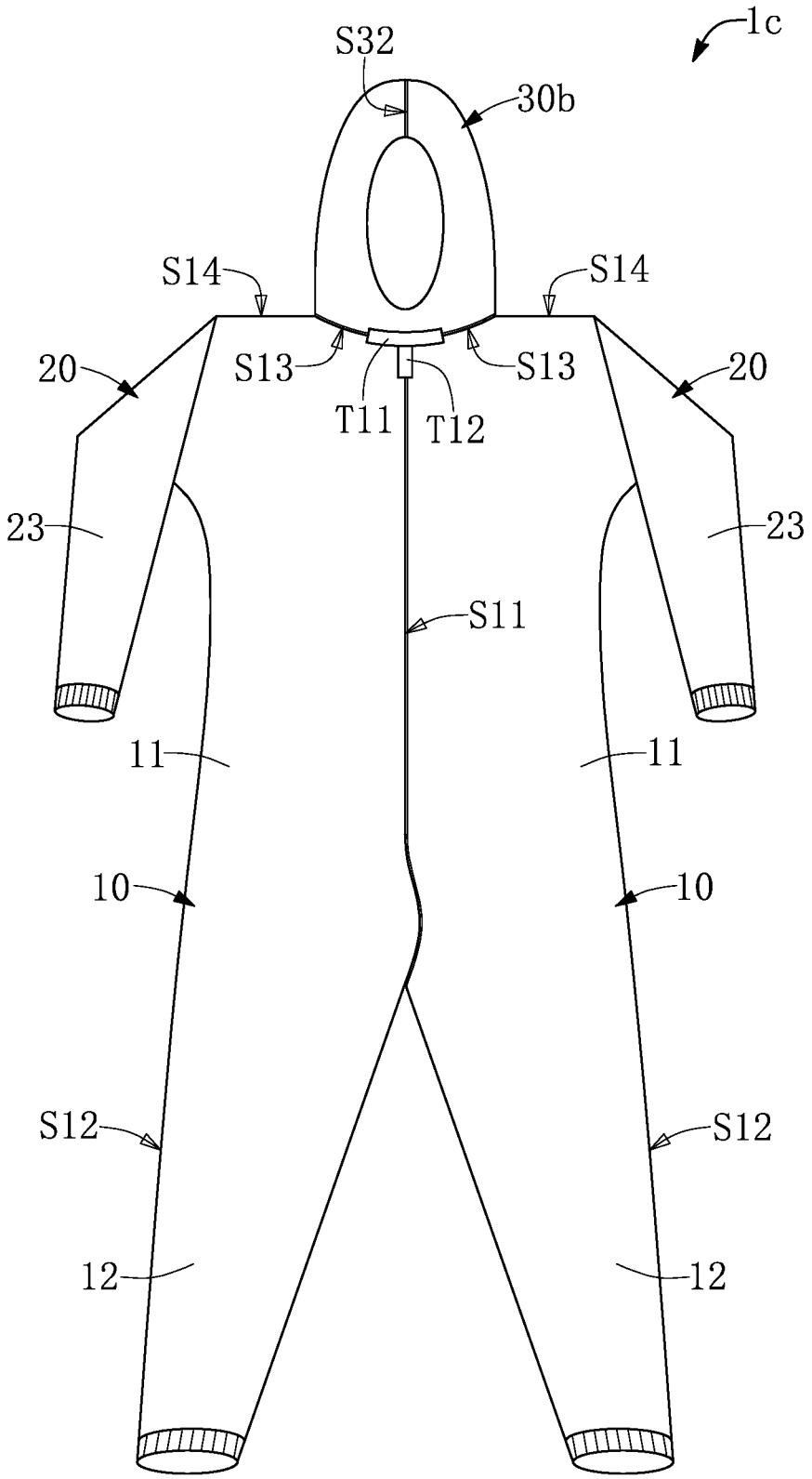
FIG. 9 is a front view of a medical protective garment according to a third embodiment of the present disclosure.
Figure 10:
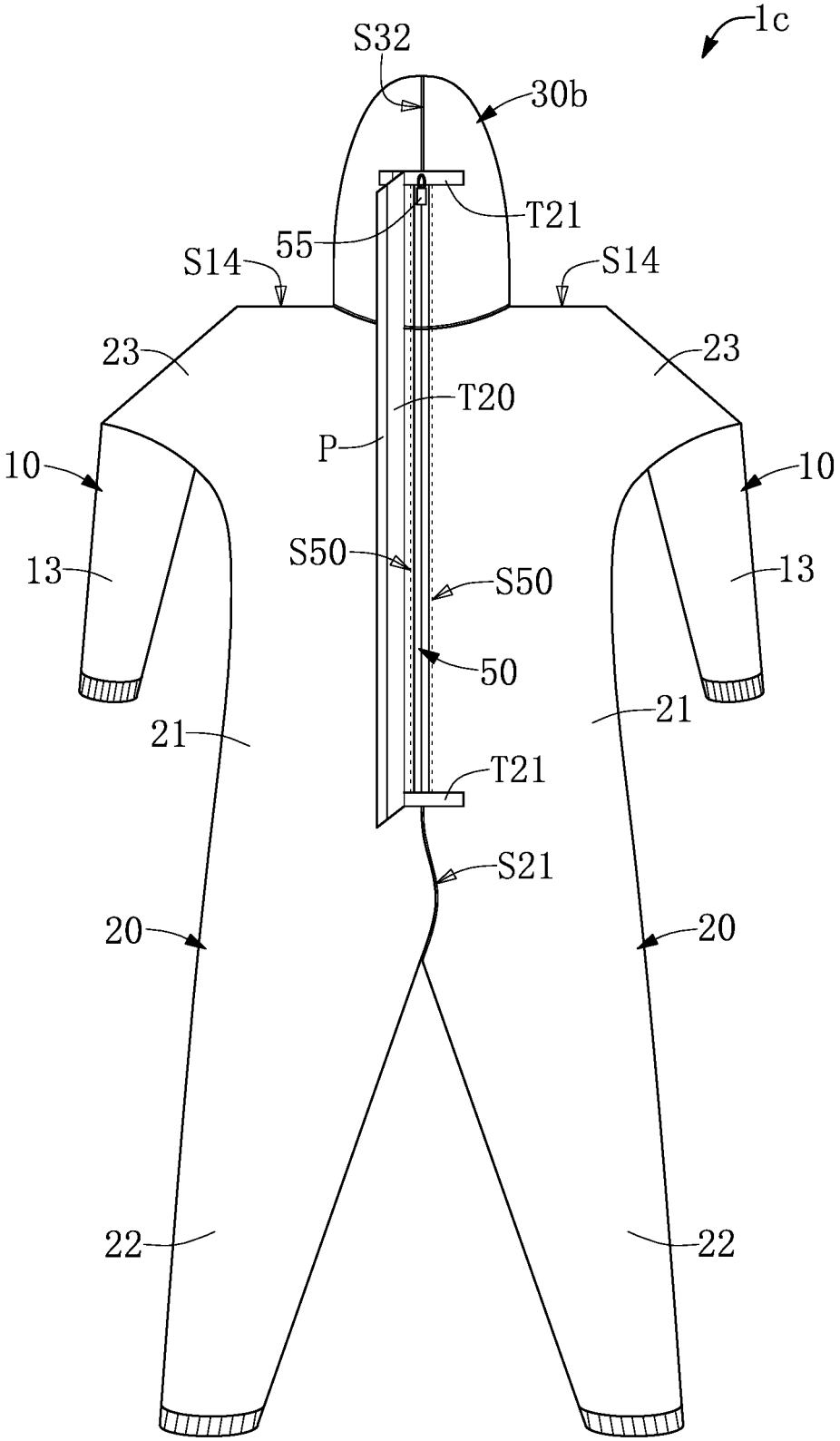
FIG. 10 is a rear view of the medical protective garment according to the third embodiment of the present disclosure.

FIG. 9 and FIG. 10 respectively represent a front and a back view of a medical protective garment according to a third embodiment of the present disclosure. The difference from the above-mentioned embodiment is that the position of the waterproof strip is arranged on the back. Since the position of the weldable zipper 50 has been changed to the back of a medical protective garment 1*c* in the present embodiment, all the connections are made by heat welding. In addition, the weldable zipper 50 and the pair of rear fabric pieces 20 are combined by heat welding, so that the two sides of the weldable zipper 50 can provide a considerable degree of protection by the zipper heat welding line S50. The protection level required for the back of the medical protective garment 1*c* is not the same as the protection level required for the front. The medical protective garment 1*c* of the present embodiment includes a pair of rear horizontal waterproof strips T21, which are attached to the upper end (hidden and omitted in the figure) and the lower end 53 of the weldable zipper 50, respectively. In other words, compared with the previous embodiment, the present embodiment omits the waterproof strips on both sides of the weldable zipper 50.

In addition, in order to strengthen the protective effect, a back waterproof strip T20 can be attached to the weldable zipper 50 on the back of the medical protective garment 1*c* in the present embodiment. One side of the back waterproof strip T20 is first attached to any one side of the weldable zipper 50, and a release paper P is left on the other side of the back waterproof strip T20. After the medical staff put on the medical protective garment 1*c*, they can tear off the release paper P, and cover the weldable zipper 50 with the back waterproof strip T20, and attach it to the other side of the weldable zipper 50. Therefore, the weldable zipper 50 can be completely covered to achieve a good protective effect.

BENEFICIAL EFFECTS OF THE EMBODIMENTS

In conclusion, one of the beneficial effects of the present disclosure is that the protective performance of the medical protective garment in the present disclosure is improved by heat welding all connections and cooperating with the structural features of the weldable zipper. It can also reduce the number of waterproof strips, which can reduce the time and cost associated with manual labor.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A medical protective garment, comprising:

a pair of first fabric pieces each including an integral first body part, an integral first trouser and an integral first sleeve that are connected to each other;

a pair of second fabric pieces, each including an integral second body part, an integral second trouser and an integral second sleeve that are connected to each other;

a headgear fabric piece, wherein heat welding lines are formed on joints of the headgear fabric piece, the pair of first fabric pieces and the pair of second fabric pieces; and a weldable zipper including a pair of zipper strips, and a material of the pair of zipper strips being heat welded to the pair of first fabric pieces;

wherein each of the pair of zipper strips of the weldable zipper includes a sheet, and wherein a convex rib is formed on a perimeter edge of one of the sheets and a clamping strip is formed on a perimeter edge of another one of the sheets, and the clamping strip clamps the convex rib and each sheet further includes a guiding protrusion;

wherein one of the guiding protrusions is parallel to the convex rib, another one of the guiding protrusions is parallel to the clamping strip, and each of the guiding protrusions is configured to guide a roller of a hot melt machine, so that zipper heat welding lines are respectively formed to connect the zipper strips with the pair of first fabric pieces, and are parallel to the guiding protrusion;

wherein one of the zipper heat welding lines is formed between one of the guiding protrusions and the convex rib, and another one of the zipper heat welding lines is formed between the other guiding protrusion and the clamping strip, the zipper heat welding lines are respectively formed on the pair of first fabric pieces, and the guiding protrusions are respectively protruded toward the pair of first fabric pieces.

2. The medical protective garment according to claim 1, wherein the weldable zipper is disposed between the pair of first fabric pieces, and the pair of zipper strips of the weldable zipper are respectively connected to an inner edge of the pair of first fabric pieces.

3. The medical protective garment according to claim 2, wherein a zipper pull of the weldable zipper is connected to a drawstring.

4. The medical protective garment according to claim 1, wherein the pair of zipper strips of the weldable zipper are further connected to the headgear fabric piece through a neck heat welding line.

5. The medical protective garment according to claim 1, wherein each of the heat welding lines includes a heat welding solid line and a heat welding broken line, and the heat welding broken line is parallel to the heat welding solid line.

6. The medical protective garment according to claim 1, wherein the weldable zipper is disposed between the pair of first fabric pieces, the pair of zipper strips of the weldable zipper are respectively connected to an inner edge of the pair of first fabric pieces, and wherein a horizontal waterproof strip is attached to a lower end of the weldable zipper.

7. The medical protective garment according to claim 6, wherein the medical protective garment includes a central heat welding line and a neck heat welding line, the central heat welding line being connected to an inner edge of the pair of second fabric pieces and extending to the headgear fabric piece, and the neck heat welding line being connected to the headgear fabric piece through the pair of second fabric pieces.

* * * * *